United States Patent [19]

Fiorentino et al.

[11] Patent Number: 4,939,800

[45] Date of Patent: Jul. 10, 1990

[54] EYE WASH STATION

[75] Inventors: Frank S. Fiorentino, Thousand Oaks; Douglas M. Patton, Irvine, both of Calif.

[73] Assignee: McKesson Corporation, San Francisco, Calif.

[21] Appl. No.: 289,491

[22] Filed: Dec. 21, 1988

Related U.S. Application Data

[63] Continuation of Ser. No. 64,918, Jun. 19, 1987, abandoned.

[51] Int. Cl.[5] ..... A61H 33/00

[52] U.S. Cl. ..... 4/620

[58] Field of Search ..... 4/620, 624

[56] References Cited

U.S. PATENT DOCUMENTS

| | | | |
|---|---|---|---|
| 261,991 | 8/1882 | Bond | 4/627 |
| 1,564,796 | 12/1925 | Shroyer | 4/627 X |
| 1,660,260 | 2/1928 | Diago | 4/307 |
| 1,831,937 | 11/1931 | Watrous | 4/644 X |
| 2,315,233 | 3/1943 | Tully et al. | 4/644 X |
| 2,315,927 | 4/1943 | Brack | 4/644 X |
| 2,315,928 | 4/1943 | Brack | 4/644 X |
| 2,334,951 | 11/1943 | Parke et al. | 4/644 |
| 2,564,923 | 8/1951 | Patton et al. | 4/644 |
| 2,999,249 | 9/1961 | Logan | 4/620 |
| 3,413,660 | 12/1968 | Lagarelli et al. | 4/620 |
| 3,599,251 | 8/1971 | Wright | 4/620 |
| 4,012,798 | 3/1977 | Liautaud | 4/620 |
| 4,363,146 | 12/1982 | Liautaud | 4/620 |
| 4,675,924 | 6/1987 | Allison et al. | 4/620 |

FOREIGN PATENT DOCUMENTS

| | | | |
|---|---|---|---|
| 878572 | 10/1961 | United Kingdom | 4/644 |

*Primary Examiner*—Charles E. Phillips

*Attorney, Agent, or Firm*—Flehr, Hohbach, Test, Albritton & Herbert

[57] ABSTRACT

An eye wash station is provided which includes a pivotal basin to which is mounted a spray nozzle which is actuated when the basin is pivoted from a vertical to a horizontal position. In one embodiment, an independent eye wash feed tank is mounted above the top of the basin in its upright position with a conduit between the feed tank and the nozzle. In this manner, the spray is provided at a substantial continuous high pressure. Preferably, an eye wash collection tank is mounted below the basin to collect the liquid during operation. Furthermore, the basin cooperates with a vertical base member to provide a substantial enclosure for the basin when unactuated but to permit spraying when the basin is pivoted to a horizontal position.

In another embodiment, the feed tank also is disposed within a normally enclosed basin housing formed by the base member and the basin in an upright position.

4 Claims, 4 Drawing Sheets

EYE WASH STATION

This is a continuation of application Ser. No. 064,918 filed June 19, 1987, now abandoned.

BACKGROUND OF THE INVENTION

The invention relates to an emergency eye wash station in use for flushing harmful material from the eyes of workers.

A variety of such emergency eye wash stations are known. For example, a portable eye wash station is disclosed in Liautaud U.S. Pat. No. 4,363,146. It includes an L-shaped basin housing with an inverted vertical eye wash cartridge connected through a fluid line to a nozzle in a horizontal basin. A sealing membrane is placed over the spout of the cartridge which is pierced when placed into the basin housing. The station is rigid and so it takes up a substantial amount of space. Also, since the liquid is continuously above the spray nozzle, plugs must be used which are removed manually at the time of use. Furthermore, there is no provision for storing the used liquid which is sprayed when the nozzles are activated, resulting in a potential spill.

Another system is marketed by Encon Safety Products of Houston, Tex. under Model 01-1040-50. This system includes a vertical tank and a connecting basin which pivots from a vertical to a horizontal position. A surgical tube between the basin and tank is stressed while the basin is vertical to prevent liquid flow prior to actuation. However, the stressed mechanism can lead to fatigue and failure of the tube. Also, the system has no means for automatic clean-up of the sprayed liquid.

SUMMARY OF THE INVENTION

In accordance with the present invention, an eye wash station is provided which includes a pivotal basin to which is mounted a spray nozzle which is actuated when the basin is pivoted from a vertical to a horizontal position. In one embodiment, an independent eye wash feed tank is mounted above the top of the basin in its upright position with a conduit between the feed tank and the nozzle. In this manner, the spray is provided at a substantial continuous high pressure. Preferably, an eye wash collection tank is mounted below the basin to collect the liquid during operation. Furthermore, the basin cooperates with a vertical base member to provide a substantial enclosure for the basin when unactuated but to permit spraying when the basin is pivoted to a horizontal position. In a preferred embodiment, the nozzle normally is sealed by a nozzle cap with a linkage to the base member which releases the cap when the basin is pivoted to an operable position.

In another embodiment, the feed tank also is disposed within a normally enclosed basin housing formed by the base member and the basin in an upright position. Preferably, a valve is provided between the feed tank and nozzle to block liquid flow from the basin housing is in a closed position and to permit flow when in an operable position. Preferably the feed tank is a cartridge removable from the basin housing. A preferred form of valve is formed as follows. A receptacle in the base member is provided for seating the open end of the feed tank. The nozzle is above the inlet opening when the base member and basin are upright and below it when the basin is pivoted to an operable position. This is preferably accomplished using a piercable sealing membrane over the outlet opening of the feed tank. A piercing member near the receptacle punctures the sealing membrane and permit fluid flow from the bottle when seated in the receptacle.

DESCRIPTION OF THE PREFERRED EMBODIMENTS

Figure 1:
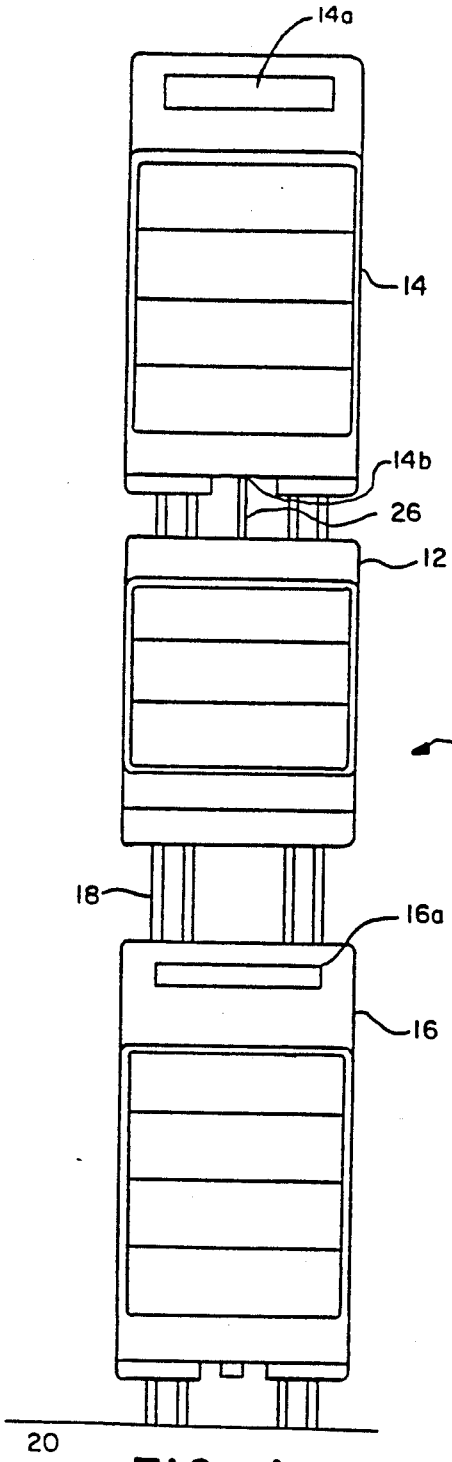
FIGS. 1 and 2 are front and side views, respectively, of one embodiment of the invention.

One preferred embodiment of the eye wash station, designated generally by the number 10, is illustrated in FIGS. 1–3 and 6. It includes basin housing means 12 with eye wash feed tank 14 above it and liquid collection tank 16 below it, all suitably formed of a moldable plastic such as polyethylene. In a preferred embodiment, all three units are mounted to the wall by conventional bracing in the form of runners 18 which extend to the floor 20 for support.

Figure 2:
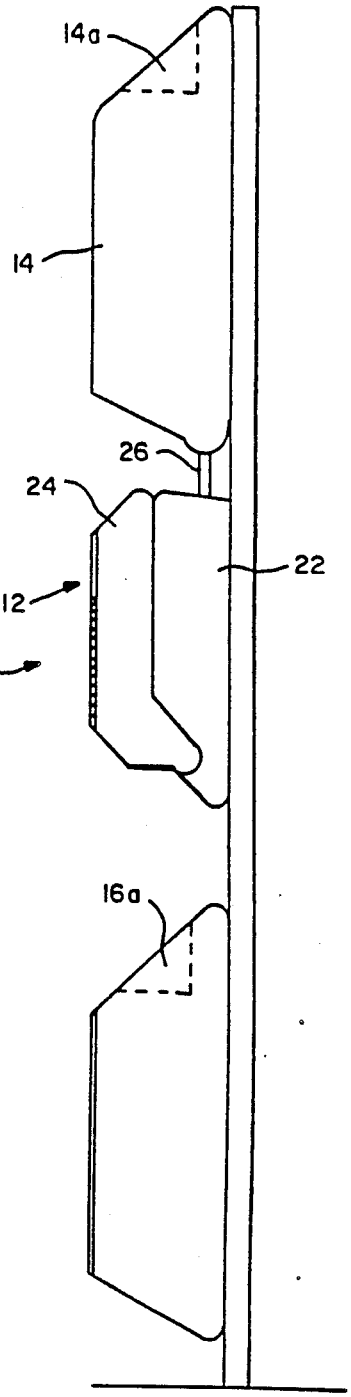

As illustrated in FIGS. 1 and 2, basin means 12, in a normal unactivated position, includes an upright vertical base member 22 which is mounted by conventional means to bracing 18 and basin 24 pivotally mounted to base member 22. In this position, base member 22 and basin 24 form a sealed enclosure. A fluid conduit in the form of a flexible tubing 26, suitably surgical tubing, interconnects the outlet opening from feed tank 14 to nozzle means 28, including spray nozzles 28(*a*), in the basin as described with respect to FIGS. 3 and 6.

Figure 3:
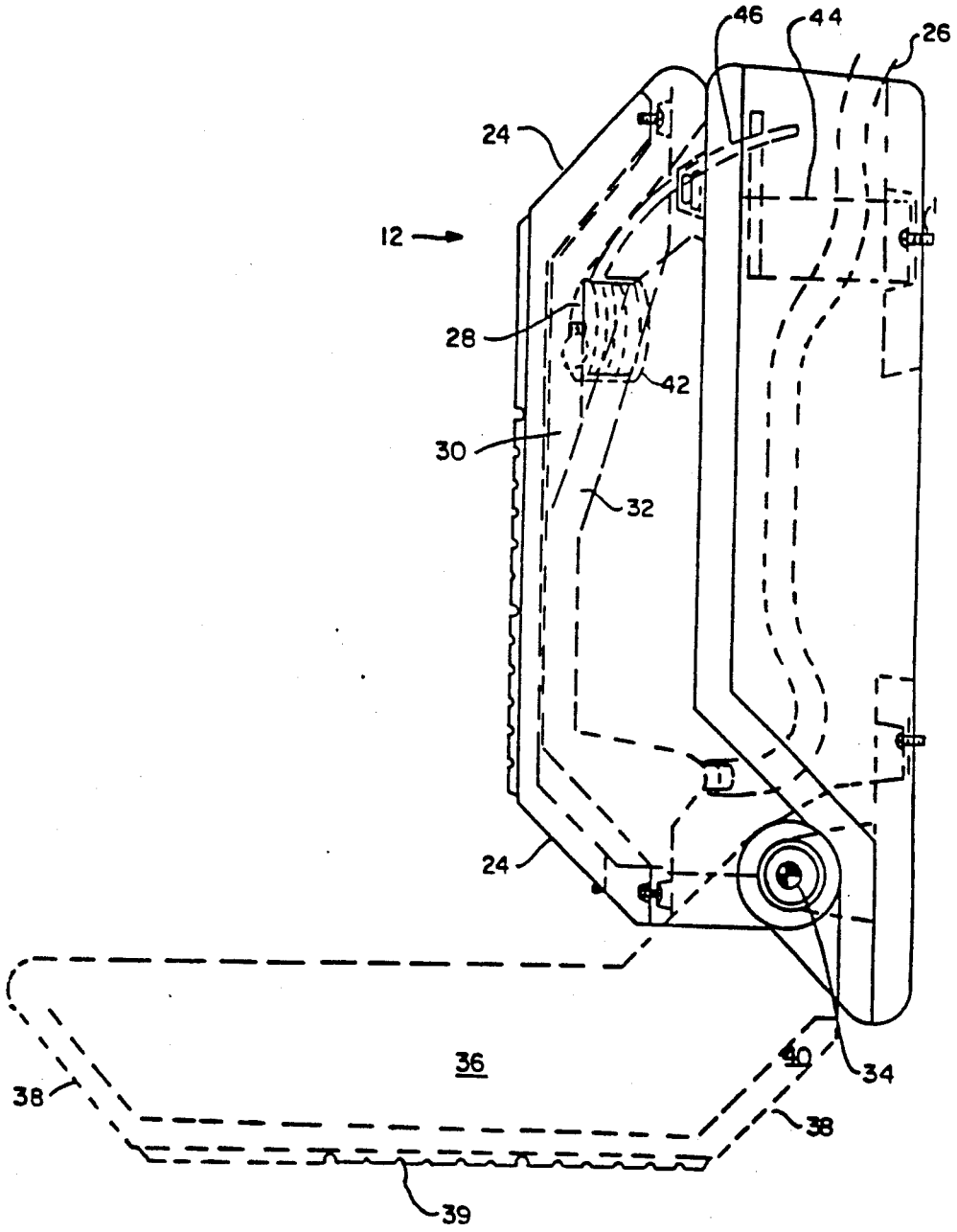
FIG. 3 is a cross-sectional view of the basin housing section of the device of FIG. 2.

Referring to FIG. 3, a cross-sectional view of the basin housing means 12 is illustrated in its normal and operable positions. A channel 30, split in a T-shaped configuration, provides liquid communication between the mounted portion of spray nozzle 28 and tubing 26. Nozzle mount 32 retains spray nozzles 28 in a fixed position.

Basin 24 is pivotally mounted to base member 22 by coupling inserts 34 which are seated in registered openings in base member 22. Basin 24 includes generally upright side walls 36, sloping end walls 38 and bottom wall 39 defining a collection basin. An outlet opening 40 is defined toward the top of end wall 38. In this manner, when the liquid fills the basin interior, it flows through outlet opening 40 into an aligned inlet opening 16(*a*) in a collection tank 16 for the collection of liquid.

Collection tank 16 is hollow and includes the aforementioned inlet opening 16(*a*) and outlet opening 16(*b*) which is normally sealed. If desired, after the system is activated, the collection tank may be unloaded by removing the tank and discharging water through 16(*a*). Alternatively, collection tank 16 may be mounted for ready dismounting and the entire tank removed so that the liquid is discharged through tank outlet 16(*a*).

Feed tank 14 may be formed of an identical character to collection tank 16 including an inlet opening 14(*a*) and an outlet opening 14(*b*). In normal operation, the preserved eye wash solution may be filled through inlet opening 14(*a*) which is closed off and virtually sealed from the atmosphere, as with a cap, to prevent contamination.

Referring again to FIG. 3, the walls of base member 22 mate with the facing portions of the side walls and end walls of the basin 24 when it is pivoted to a closed position. The interior of base member 22 is hollow providing a passage for tubing 26.

In this embodiment, the space between feed tank 14 and spray nozzles 28 in a operable position may be adjusted by correspondingly adjusting the spacing between the top of basin housing means 12 and the bottom of feed tank 14. Suitable, this distance may be from 19 inches to 21 inches. The substantial head pressure created by separating the feed tank from the basin housing means results in a uniform high pressure regardless of the amount of water remaining in the feed tank. Another advantage is that all of the contents of the tank are released during operation.

Preferably, means is provided for removably mounting nozzle caps 42 over spray nozzle means 28 to form a liquid seal on the basin when it is upright. Linking means is provided interconnecting the nozzle caps 42 and base member 22 serving to release the caps from the nozzles when the basin is pivoted to an operable position. As illustrated, such linking means includes a mounting bracket 44, suitably formed of metal, to which is attached a flexible strap 46 which is connected to cap 42. In operation, when basin 24 is pivoted to an operable position, the cap is released from nozzle means 28 to permit liquid to flow from feed tank 14 through tubing 26 into channel 30 to be sprayed out of nozzle openings 28(*a*).

Figures 4, 5:
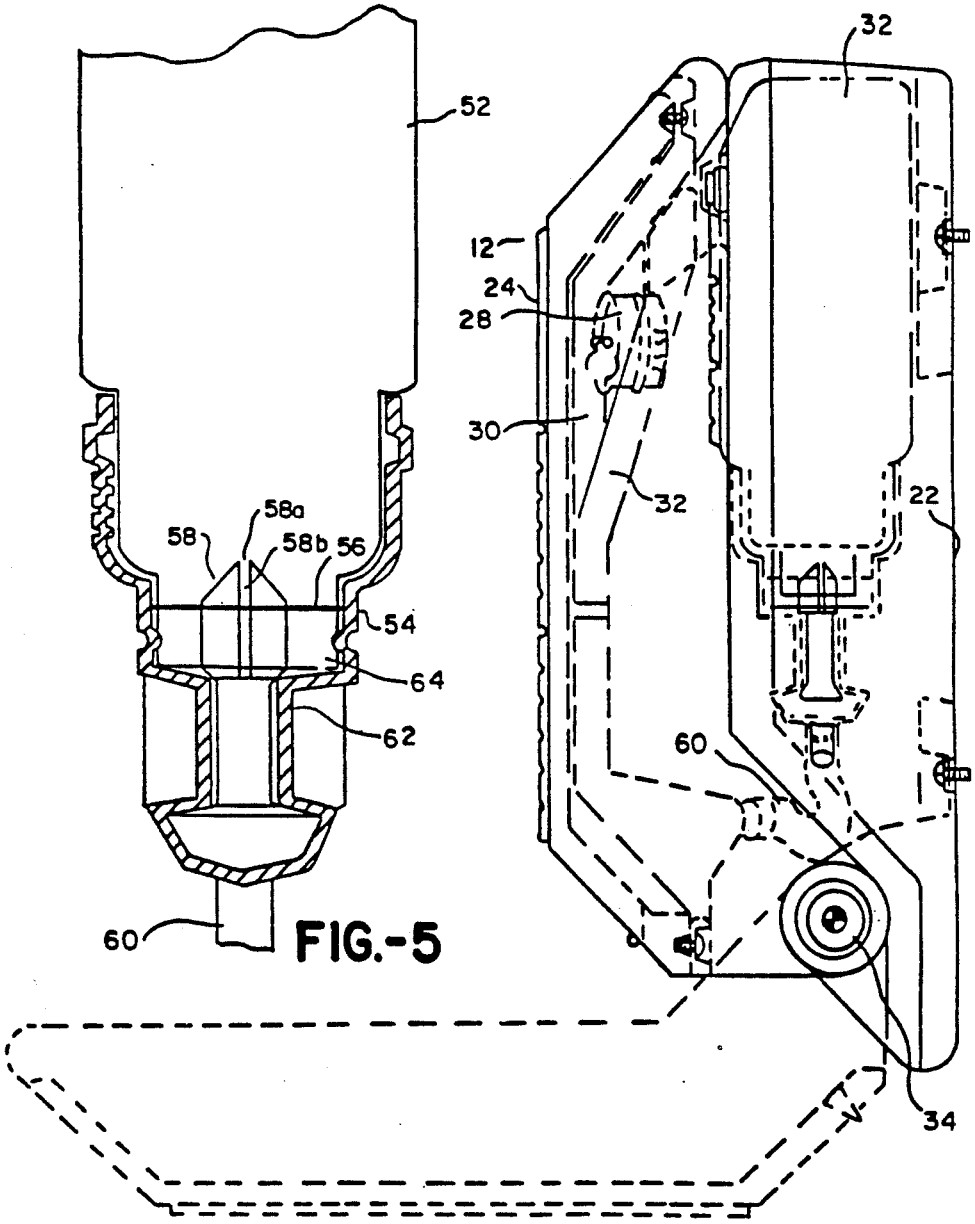
FIG. 4 is a cross-sectional view of the basin housing section of another embodiment of the invention.
FIG. 5 is an enlarged view of the bottle and receptacle of FIG. 4.
Figure 6:
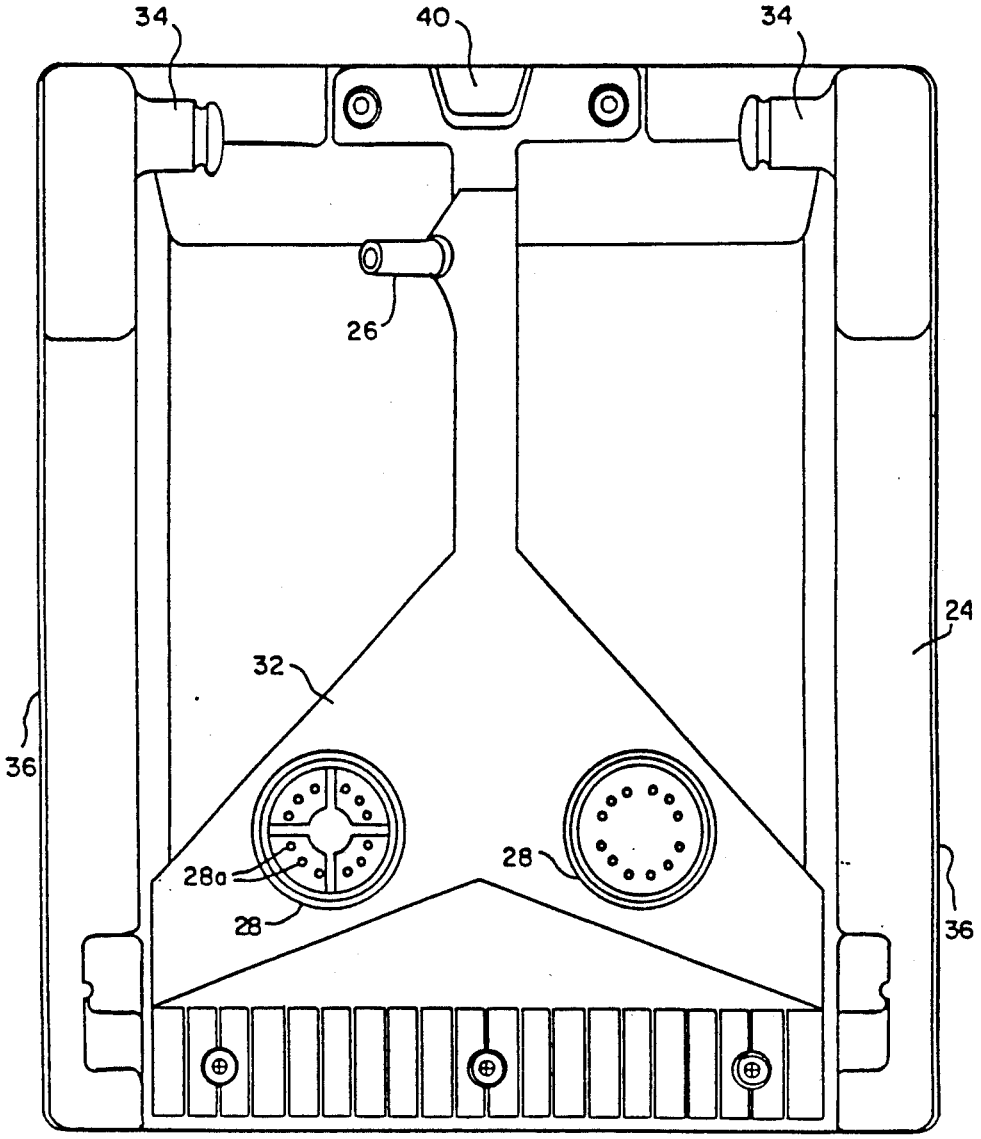
FIG. 6 is a top view of the basin of the device of FIGS. 1–4 as shown in an operable position.

In the embodiment of FIGS. 4 and 5, generally designated by the number 50, a feed tank in the form of cartridge bottle 52 is enclosed within basin housing means 12. There are many similarities between this basin housing means and the one previously described and so like parts will be designated by like numbers. Similarly, in a preferred embodiment, collection tank 16 is employed to collect the run off from basin 24. The embodiment of FIGS. 4 and 5 provides a more compact lower volume unit for use where space is at a premium.

Basin 24 pivots from a vertical fully enclosing position to a horizontal operating position on a pivot point formed by coupling insert 34. In the embodiment of FIG. 4, nozzle caps are optional because liquid valving is provided to prevent liquid from flowing out the spray nozzle 28 when basin 24 is in its normally vertical position.

Bottle 52 which is seated in a receptacle 54 and is fully enclosed in the basin housing means and, preferably, contained in base member 22. As illustrated, bottle 52 includes a piercable membrane 56 formed, e.g., of polyethelene foam. A seal breaker 58 is mounted in receptacle 54 and is formed into point 58(*a*) and includes four ribs 58(*b*) arranged in a cruciform to permit water to flow along the sides of the ribs after membrane 56 is pierced by placing bottle 52 within basin housing means 12. When the seal is broken, an air inlet opening is provided in the receptacle at the seal. Nozzles 28 are above the air inlet opening when basin 24 is in an upright position and is below the air inlet opening when the basin is pivoted to an inoperable position.

In operation, a liquid seal is formed around the cruciform preventing liquid flow from within bottle 52 into conduit 60, suitably formed of surgical tubing, which provides communication between channel 30 and spray nozzles 28. This operates in the same manner as commonly used in the bottled water dispensing art. Specifically, the water from bottle 52 supplies water only when the basin is pivoted to its operable position and nozzle means 28 is at a level below that of the air opening. In this manner, the water level in the inverted bottle fluctuates above and below this water level. At rest, the water does not escape because the air seal is produced by water contained in a small reservoir 62 below the spout 64. When activated, the water seal drops below the water spout to a level Y to allow air to enter and water to escape.

In the embodiment of FIG. 4, the basin may be formed to have a capacity to collect most of the relatively small volume of eye wash solution that has escaped from the cartridge. Used solution can be emptied by tilting the basin and pouring its contents into another container. Alternatively, a collection tank similar to that of collection tank 16 may employed below an opening in the basin.

What is claimed is:

1. An eye wash station comprising:

(a) normally enclosed basin housing means including a base member adapted to be disposed in a normally upright position and a basin mounted to said base member for pivoting between a closed position generally parallel to said base member and a second operable position transverse to said base member, (b) spray nozzle means mounted to said basin adapted to spray liquid upwardly when said basin is in an operable position, (c) an eye wash feed tank having an outlet opening and disposed within said basin housing means, and (d) liquid conduit means providing communication between said feed tank outlet openings and said spray nozzle means, said feed tank being removable from said basin housing means, said base member including a receptacle communicating with said liquid conduit means for seating the outlet opening of said feed tank so that an air inlet opening is provided, said spray nozzle means being above said air inlet opening with said base member and said basin in upright positions and being below said air inlet opening when said basin is pivoted to an operable position.

2. The eye wash station of claim 1 in which said feed tank comprises a bottle with a piercable sealing membrane over its opening, said eye wash station further comprising a piercing member proximal to said receptacle for piercing said sealing membrane to permit liquid flow from said bottle when seated in said receptacle.

3. An eye wash station comprising:

(a) basin housing means including a basin adapted for pivoting between a normal upright position and a generally horizontal operable position, said basin housing means including an upright base member and said basin pivots from a pivot point at a lower region of said base member, (b) spray nozzle means mounted to said basin to spray upwardly when said basin is in an operable position, said spray nozzle means includes at least one nozzle, said spray nozzle means further comprising a removable nozzle cap seated on said one nozzle when said basin is upright, (c) linking means interconnecting said nozzle cap and base member serving to release said cap from said one nozzle when said basin is pivoted to an operable position, (d) an independent eye wash feed tank mounted above the top of said basin in its upright position, and (e) liquid conduit means for providing communication between said feed tank and said spray nozzle means.

4. An eye wash station comprising:

(a) normally enclosed basin housing means including base member adapted to be disposed in a normally upright position and a basin mounted to said base member for pivoting between a closed position generally parallel to said base member and a second operable position transverse to said base member, (b) spray nozzle means mounted to said basin adapted to spray liquid upwardly when said basin is in an operable position, (c) said spray nozzle means includes at least one nozzle, said spray nozzle means further comprising a removable nozzle cap seated on said one nozzle, (d) linking means interconnecting said nozzle cap and base member serving to release said cap from said one nozzle when said basin is pivoted to an operable position, (e) an eye wash feed tank having an outlet opening and disposed within said basin housing means, and (f) liquid conduit means providing communication between said feed tank outlet openings and said spray nozzle means.

* * * * *